United States Patent [19]

Arnau-Munoz et al.

[11] Patent Number: 4,835,804

[45] Date of Patent: Jun. 6, 1989

[54] MULTIPLE COMPARTMENT CONTAINER LAUNDERING METHOD

[75] Inventors: José L. Arnau-Munoz, Montigny-Le-Bretonneux; Henri Cornette, Pontoise, both of France

[73] Assignee: The Procter & Gamble Company, Cincinnati, Ohio

[21] Appl. No.: 173,484

[22] Filed: Mar. 25, 1988

[30] Foreign Application Priority Data

Mar. 25, 1987 [FR] France ..... 87-04167

[51] Int. Cl.[4] ..... D06F 39/02

[52] U.S. Cl. ..... 8/158; 8/137; 68/17 R; 206/0.5; 252/90; 252/95

[58] Field of Search ..... 8/137, 158, 159; 252/90, 92, 95; 206/0.5, 216; 68/17 R, 235 R

[56] References Cited

U.S. PATENT DOCUMENTS

| | | | |
|---|---|---|---|
| 2,289,508 | 7/1942 | Lawler | 206/0.5 |
| 2,412,833 | 12/1946 | Prager | 215/6 |
| 3,289,887 | 12/1966 | Farrar et al. | 222/1 |
| 3,413,229 | 11/1968 | Bianco et al. | 252/90 |
| 4,234,442 | 11/1980 | Cornelissens | 8/137 X |
| 4,410,441 | 10/1983 | Davies et al. | 252/90 X |
| 4,513,459 | 4/1985 | Doughty | 252/90 X |
| 4,555,354 | 11/1985 | Clarke et al. | 252/92 X |
| 4,563,186 | 7/1986 | Flynn et al. | 8/137 |
| 4,588,080 | 5/1986 | Ginn | 252/90 X |
| 4,740,326 | 4/1988 | Hortel et al. | 252/90 |
| 4,776,455 | 10/1988 | Anderson et al. | 252/92 X |

FOREIGN PATENT DOCUMENTS

| | | |
|---|---|---|
| 0132726 | 2/1985 | European Pat. Off. . |
| 0151549 | 8/1985 | European Pat. Off. . |
| 0152359 | 8/1985 | European Pat. Off. . |

*Primary Examiner*—Philip R. Coe

*Attorney, Agent, or Firm*—John V. Gorman; Jerry J. Yetter; Richard C. Witte

[57] ABSTRACT

A container containing a predetermined quantity of incompatible detergent compositions is introduced into the drum of a machine for washing laundry. The container comprises compartments which separately receive the constituents of the detergent compositions which are mutually incompatible, for example, the constituents which release active oxygen or chlorine and the remainder of the detergent compositions are separated. Each of the compartments has openings for permitting its contents to diffuse into the washing machine during the washing process.

6 Claims, 4 Drawing Sheets

MULTIPLE COMPARTMENT CONTAINER LAUNDERING METHOD

FIELD OF INVENTION

The present invention belongs to the field of technology of washing laundry by machine. Particularly, the invention relates to a washing process making it possible to employ substances which do not exhibit satisfactory compatibility when brought together and a multiple compartment container for implementing a process of this kind.

BACKGROUND OF THE INVENTION

In the field of machine washing of laundry, the Applicant Company is already the owner or titleholder of a number of patent applications, which may be mentioned by way of reference to illustrate the state of the art.

The application FR No. 84/06,151, filed on Apr. 18, 1984 for "Process for washing linen in a machine with a liquid detergent and device for its application" relates particularly to a device, generally reloadable, which is firstly filled with liquid detergent and is then placed in the drum of the machine with the laundry to be washed. The detergent contained in the device diffuses gradually into the washing medium and into the laundry placed in the machine. In one embodiment, the device comprises a filling orifice and vents for the gradual release of the the liquid within the laundry during the washing operation.

Patent Application FR No. 84/13,210, filed on Aug. 24, 1984 for "Device for washing in a machine with a detergent liquid and process employing the said device" relates to a device of the above type, which is more particularly characterized in that it is of a substantially spherical shape. A certain number of orifices permit the liquid to diffuse.

It is known, furthermore, that the use of liquid washing aids gives rise to individual difficulties because of the risks of incompatibility of some of their constituents.

Thus, although it is possible to package the constituents of a powdered washing aid in the same container, it is not permissible in practice to formulate liquid washing aids in advance when their formulations contain, at the same time as the other active constituents, constituents capable of releasing active oxygen or chlorine, for example peroxidic constituents of the type of perborates or other inorganic or organic peroxidic salts. It is known, however, that the presence of active oxygen or chlorine is quite desirable if optimum effectiveness is to be obtained. In the case of liquid washing aids, attempts are being made, therefore, to produce formulations containing the same basic combinations as those in the granular or powdered detergents. However, practical impossibilities then stand in the way, because it is known that when traditional active components and perchlorinated or peroxidic components are incorporated together within a liquid washing aid, these compounds rapidly lose their effectiveness. Thus, it has been found that after storage periods of the order of two weeks, the active oxygen of these peroxidic compounds is practically completely released, thus becoming available at the time of use in the wash bath.

By the way of reference which illustrates the state of the art, there may be mentioned the European Patent Application published under No. 0,132,726, which describes the use of a package in the form of a sachet containing a substance as well as another sachet of smaller size containing another substance which is not compatible with the first. The material of which the outer sachet is made is water-permeable, as is that of the inner sachet, but the materials are chosen so as to permit the diffusion of the substances which they contain at different temperatures, which enables the packaging to be adapted to practical needs, for example of washing. The teaching of this prior document consists therefore in presenting in the same packaging individual sachets capable of containing liquid substances, choosing the sachets so that they release the substances which they contain at different temperatures. Such packaging containers are single-use and comprise a plurality of compartments, the basic concept resulting in an application of the substances held in each of the individual sachets which is necessarily offset in time. Furthermore, it is essential that the latter be soluble in water or have particular properties in order to allow water to pass at a specific temperature. This is why the outer sachet is made from a sheet of open-pore polyurethane foam, while the inner sachet consists of polyvinyl alcohol.

BRIEF SUMMARY OF THE INVENTION

The invention is a process for the machine washing of laundry in which there is introduced into the drum of a washing machine a container containing a predetermined quantity of a detergent composition. The container is adapted to permit the gradual diffusion of the detergent composition during the washing operation. The process is characterized in that the constituents of the detergent composition which do not have satisfactory mutual compatibility are packaged separately in isolated individual compartments of the container. Each of the compartments has one or more openings, such that when the container is placed in the drum of the washing machine the constituents of the detergent composition can simultaneously and separately diffuse during the washing operation.

BRIEF DESCRIPTION OF THE DRAWINGS

The invention will be illustrated further, without being limited in any manner, by the description which follows and which is given with an example of use of a single-use, multi-compartment container, with reference to the attached drawings, in which.

DETAILED DESCRIPTION OF THE INVENTION

Figure 1:
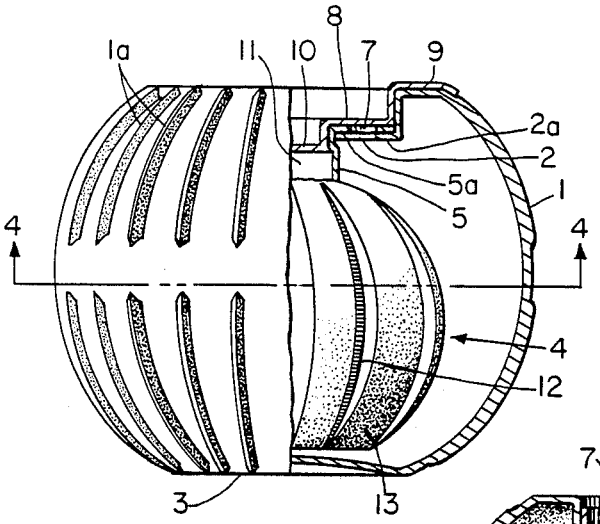
FIG. 1 is a partial vertical sectional view of a container capable of being employed in the process of the invention.

The subject of the invention is a process for the machine washing of laundry which is of the general type according to which a container containing a predetermined quantity of a detergent composition, advantageously liquid, composition is inserted into the drum of the washing machine, the container being designed to permit the gradual diffusion of this composition during the washing operation. The invention provides an improvement to this method by virtue of the use of a packaging container comprising several compartments and permitting the contents of each of these compartments to be delivered simultaneously at the time of use, this being done independently of the temperature of the medium. In a process of this kind, the materials of which the walls of the compartments are made are of no critical importance, and, in contrast to the teaching of the above-mentioned European Patent application No. 0,132,726, these walls are impervious to water, the contents of each of the compartments being emptied through orifices provided beforehand.

The process according to the invention is therefore more particularly characterized in that the constituents of the detergent composition which do not have a satisfactory mutual compatibility are packaged separately in individual compartments of the container which is inserted into the drum of the washing machine, each of the compartments having openings such that, when the container is placed in the drum, the constituents of the detergent composition diffuse simultaneously and separately during the washing operation.

The process of the invention thus provides a solution to the technical problem posed by the use of washing aid formulations, above all those which are liquid, especially those which contain constituents intended to release active oxygen or chlorine during the washing operation. Thus, it is possible to employ in the process of the invention substances which are wholly compatible or mutually incompatible and which are to be delivered simultaneously into a washing operation.

The process may be employed at the time of use, that is to say of washing, with a container in which the substance or the mixture of substances which cannot coexist during storage is introduced into each of the compartments. However, in a fair number of cases, a process of this kind gives rise to many handling operations with different sources of substances, and this can complicate its use in practice.

It is preferable by far in the process of the invention to apply a container of the single-use type containing beforehand in each of the compartments a predetermined quantity of substance or of a combination of substances. For example, in the case of a container with two compartments, which is to function as a dispensing and distributing device, in accordance with the general teaching of the above mentioned French Patent Applications Nos. 84/06,151 of Apr. 18, 1984 and 84/13,210 of Aug. 24, 1984, an inner compartment contains the constituent intended to release active chlorine or oxygen, while the other compartment contains the remainder of the detergent formulation. A removable hood crowns the container. The hood is taken off, the container is placed in the drum of the machine with the laundry to be washed. The detergent and the active constituent which are held therein diffuse gradually into the washing medium and into the laundry placed in the machine, and this takes place simultaneously, by virtue of the gradual outflow of the detergent and of this constituent. The best results for washing laundry are thus obtained.

A single-use container capable of being used in an optimum manner in the washing process according to the invention, forms the subject of the French Patent Application filed by the Applicant Company on the same date for "Single-use multicompartment container, production and application, especially for washing linen". In the present description it will be sufficient to recall that this single-use container is designed for packaging substances which do not exhibit satisfactory compatibility when brought together, and, to this end, comprises several compartments which are allocated respectively to these substances. The container comprises an outer enclosure defining a compartment of overall spherical shape, a flat bottom, a circular opening diametrically opposed to the bottom and at least one inner compartment bounded by a wall extending completely inside the outer enclosure. The inner compartment has a circular hole, or orifice, of smaller diameter than the opening of the enclosure and arranged concentrically with the opening. The walls of the enclosure and of the compartment are joined at the level of their respective opening and orifices, forming an annular region which comprises a certain number of holes. A removable hood crowns and shuts off the inner orifice and the holes in the annular region, so that the container has, overall, at least one inner compartment capable of receiving a first substance—or a mixture of mutually compatible substances—and at least one other compartment extending between the outer enclosure and the wall of the inner compartment and capable of receiving a second substance (or mixture of substances) which is relatively incompatible with the first, the contents of these two compartments being isolated from each other when the hood is placed in position. When the hood is removed, the substance in the inner compartment can flow freely through the orifice in the latter and the substance in the other compartment can flow freely through the holes in the annular region, so that all the substances held in the container are then available together.

Within the meaning of the present description, the expression "of overall spherical shape", which is employed to define the outer enclosure of the container, should not be understood as characterizing solely a sphere or a virtual sphere. This expression includes other surfaces of revolution of the ovoid type, whose curvatures are such that the container does not cause any damage to the laundry in a machine washing operation during which the container is placed in the drum.

The inner compartment, for its part, may be bounded by a wall of any shape, bearing in mind the preferred technology employed in its manufacture and described hereinafter, it is generally a surface of revolution, of the spherical or ovoid type.

The container, as defined above, is produced by the general technology of blowing or of injection blow-molding of plastics, characterized in that it comprises the following series of steps:

(1) the body of the outer enclosure with its circular opening and its flat bottom is fabricated, (2) the enclosure is filled with the desired quantity of the first substance, (3) an insert equipped with a plastic sheath is inserted through the said opening until the upper part of the sheath, of annular shape, comes to bear substantially on the edges of the opening in the enclosure, (4) the sheath is used to fabricate the inner compartment of the container, (5) holes are pierced in the annular region formed in the upper part of the inner compartment, (6) the inner compartment is filled with the desired quantity of a second substance, and (7) the upper part of the container is crowned with the hood.

The process described above may comprise numerous alternative forms which differ in some of their steps or in the sequence of the said steps.

In the present description, an alternative form will be indicated, which corresponds to a particularly advantageous way of practical implementation, according to which the process comprises the following steps:

(1b) the body of the outer enclosure with its circular opening and its flat bottom is fabricated, (2b) an insert equipped with a plastic sheath whose upper part of annular shape has holes made beforehand is inserted through the said opening until the said upper part comes to bear substantially on the edges of the opening in the enclosure, (3b) the sheath is used to fabricate the inner compartment of the container, (4b) and (5b) the body of the enclosure and the inner compartment are filled with the respective desired quantities of the first and second substance, and (6b) the upper part of the container is crowned with the hood.

In this alternative form, steps (4b) and (5b) may be in any order.

Whatever the way of implementing the process, inner compartment may be formed in a number of ways.

A container of the above mentioned type, or produced by the process just described, makes it possible to package substances which are not sufficiently compatible with each other to permit storage conditions which correspond to practical needs. As an example, a sensitive constituent for a liquid washing aid, especially a constituent capable of releasing active chlorine or oxygen, for example an additive based on peroxidic compounds, may be introduced into the inner compartment, the remainder of the washing aid formulation, preferably liquid, being placed outside this inner compartment, and in the outer enclosure.

The description given above is essentially that of the construction of a container having two compartments, but needless to say, the same fabrication technology may be employed to produce successive inner compartments. It suffices to provide the appropriate number of inserts with plastic sheaths, in order to produce each compartment. The characteristic which is common to all these compartments is that they have holes, or vents, organized so that when the hood covering the whole is removed, the respective contents of these compartments can flow freely into the drum of a washing machine.

Bearing in mind the single-use purpose of the container according to the invention, the latter is generally incapable of being reused and, in particular, at the end of a machine washing cycle, once the products (detergent compositions and additive) have completely left their respective compartments, the whole container is generally deformed, but its constituent parts nevertheless remain integrally attached to each other, and this makes it possible, on the one hand, not to damage the laundry and, on the other hand, not to give rise to bits capable of blocking the pipework. Thus, once the washing of the laundry is finished, the container is recovered from the drum of the machine, generally in a collapsed form.

As already said, the washing process according to the invention is thus preferably employed with a single-use, multi-compartment container. However, the process may also employ containers of different design, comprising compartments separted by walls which are impervious to the aqueous medium and to the liquid products which are usually employed in the technology of washing. In fact, the process according to the invention is based on a directed diffusion through the openings with which the compartments are respectively provided.

For ease of description, the container has first of all been shown in FIGS. 1 to 6 without reference being made to the substances which it contains. The production of a complete container is illustrated in FIGS. 7 to 12, with FIG. 12 in particular showing a single-use container with two compartments, and the protective hood removed.

As illustrated in FIG. 1, the container comprises an outer enclosure (1) defining a compartment of overall spherical shape having a flat bottom (3) with a circular opening (2) diametrically opposed to the bottom (3). This circular opening (2) is bounded by an annular surface (2*a*) lying in a plane substantially parallel to that of the bottom (3). This enclosure may have a thickness of, for example 0.5 mm and may be made of polyethylene, polypropylene, polycarbonate and a combination of such polymers, with or without adjuvants. To make the wall (1) sufficiently rigid, its outer periphery is provided with corrugations (1*a*) which can be seen in the left half of FIG. 1 and in FIG. 2.

Figure 3:
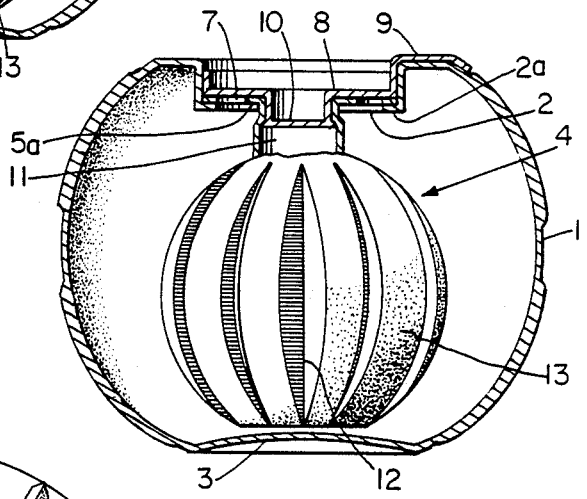
FIG. 3 is a partial vertical sectional view of the container of FIG. 1, taken along line 3—3 of FIG. 2.
Figure 2:
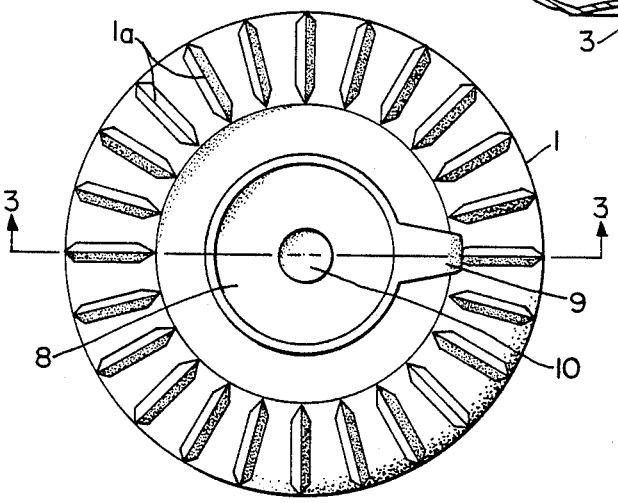
FIG. 2 is a top plan view of the container of FIG. 1.
Figure 4:
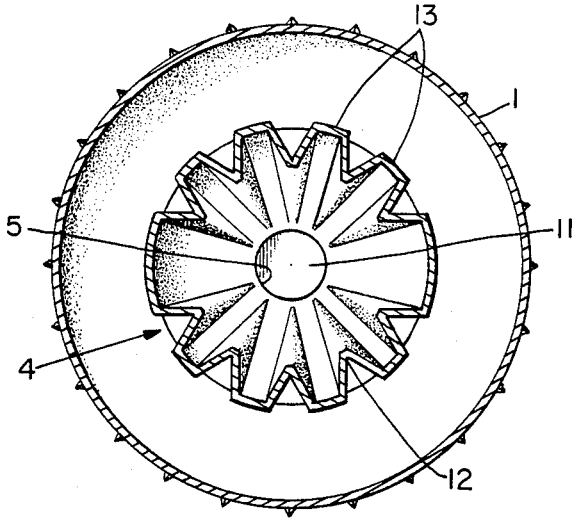
FIG. 4 is a horizontal sectional view of the container of FIG. 1, with the protective hood removed, taken along line 4—4 of FIG. 1.
Figure 6:
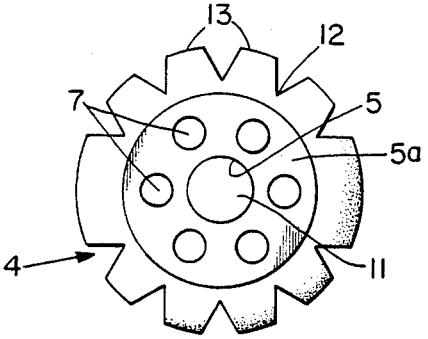
FIG. 6 is a top plan view of the inner compartment of the container of FIG. 1.

The container also comprises a separate inner compartment indicated generally by reference (4) and situated wholly inside the outer enclosure (1). This compartment is illustrated in the right-hand side of FIG. 1, and in FIG. 3. The compartment (4) has a wall forming bellows (12). In the upper part of the inner compartment (4), as seen in FIG. 3, a cylindrical wall (5) is arranged and this extends firstly vertically and then horizontally to come to bear (flange (5*a*)) on the annular edge (2*a*) of the (2) of the outer enclosure (1). The inner compartment (4) is thus open near the top via a hole, orifice (11), of circular cross-section. Similarly, a plurality of holes (7) (these holes are six in number in the example shown) are distributed uniformly around the central orifice (11) as shown in FIGS. 4 and 6.

Figure 5:
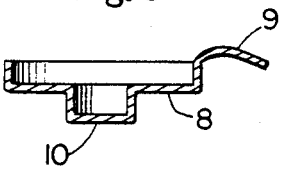
FIG. 5 is a vertical sectional view of the protective hood.

The container is closed by a protective stopper which is illustrated in FIG. 5. This stopper has a cylindrical projection (10) which fits into the orifice (11) of the inner compartment (4). This projection (10) is connected to a wall (8) which is applied onto the annular flange (5*a*), in order to close the holes (7) made in the latter. Lastly, the stopper ends in a small tongue (9) which enables the stopper to be manipulated.

The materials of which the inner compartment (4) is made are chosen from the same polymers as those of the outer enclosure (1) but it is preferable that they should have different rigidity characteristics when compared with these.

When the container is empty, its average weight is of the order of 8 to 15 g.

The operation of a single-use container capable of being used in the process of the invention will now be described, with reference to FIGS. 7 to 12.

Figure 7:
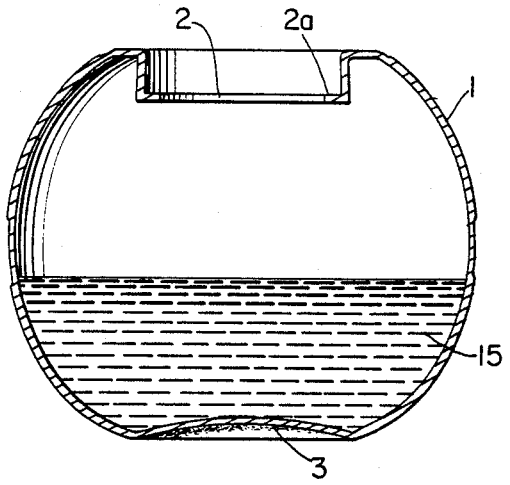
FIG. 7 is a vertical sectional view of the outer enclosure when partially filled with a liquid.

To avoid increasing the number of figures, not all of the stages of the process have been illustrated in the drawings. For example, FIG. 7 shows the body (1) of the outer enclosure which is produced by blowing or injection blow-molding with its top opening (2) bounded by the annular rim (2*a*) and its flat bottom (3). The same FIG. 7 shows a liquid product (15) which has been introduced into the enclosure (1) once the latter has been produced. The product (15) is, for example, a liquid detergent formulation not containing an additive of the type of peroxidic compounds. The volume of the enclosure (1) and the quantity of liquid product (15) are calculated relative to each other, bearing in mind that the container is designed to receive a single dose with a view to a subsequent operation of washing laundry. The quantity of liquid (15) must therefore be sufficient to ensure this function, the volume of the enclosure (1) being sized so as to enable the other steps to take place in succession.

Figure 8:
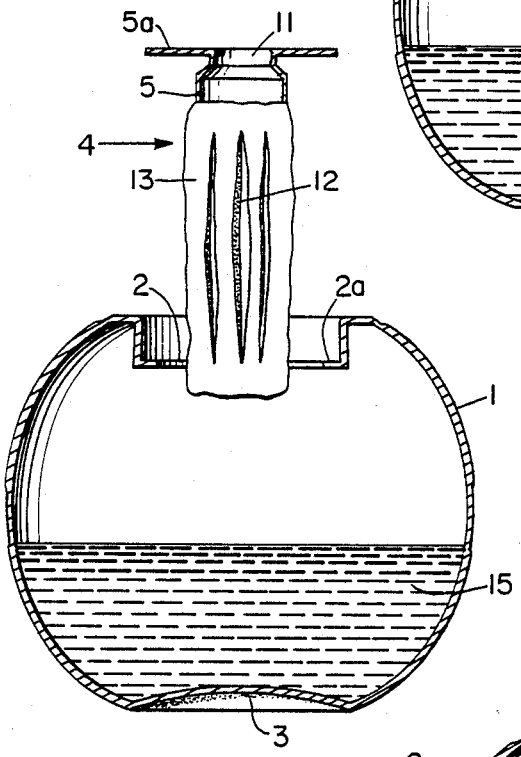
FIG. 8 is a partial vertical sectional view of the inner compartment being inserted into the outer enclosure which is shown in vertical section.

FIG. 8 illustrates the beginning of installation of an insert bearing a plastic sheath (13). The cross-section of the sheath (13) is smaller than the diameter of the opening (2). In order to make the insertion possible, a vacuum or a suction may be applied to the interior of the sheath (13), through the upper opening (11). The sheath (13) preferably includes a bellows structure (12). In its upper part, the sheath (13) is joined to a cylindrical portion (5) to which is attached a wall (5*a*) in the form of a flange, in the middle of which is the orifice (11).

Figure 9:
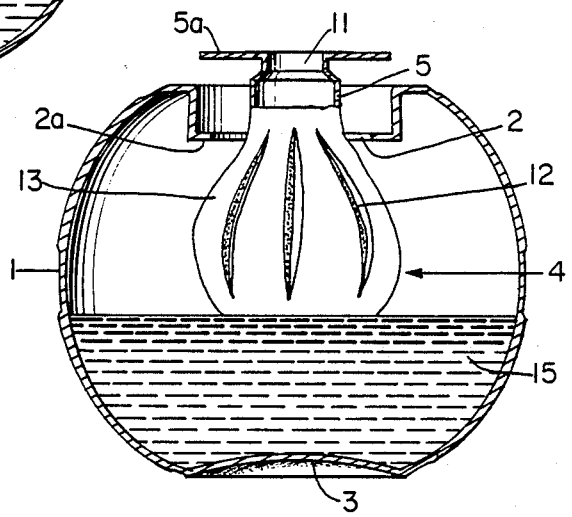
FIG. 9 is a partial vertical sectional view of the inner enclosure reaching the level of the liquid in the outer enclosure, which is shown in vertical section.
Figure 10:
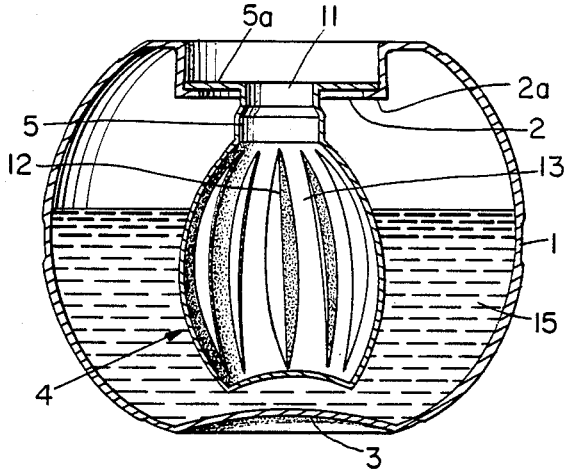
FIG. 10 is a vertical sectional view of the assembled container, showing the inner compartment within the liquid contained by the outer enclosure.

FIG. 9 illustrates the progress of insertion of the sheath (13) into the enclosure (1). It can be seen that the flange (5*a*) is sized so as to cover virtually the whole of the opening (2) until the arrangement shown in FIG. 10 is reached, where it can be seen that the flange (5*a*) comes to bear on the annular rim (2*a*) of the enclosure (1). When this situation i$ reached, the vacuum which may have been applied to the interior of the sheath (13) is broken. This interruption of suction may take place when the flange (5*a*) is actually bearing on the annular edge (2*a*), but it is also possible, as shown in FIGS. 9 and 10, for the suction to be cut off as soon as the cylindrical part (5) has moved past the opening (2) in the outer enclosure (1), so that a blowing operation may commence inside the sheath (13) as soon as the situation illustrated in FIG. 10 is reached.

Figure 11:
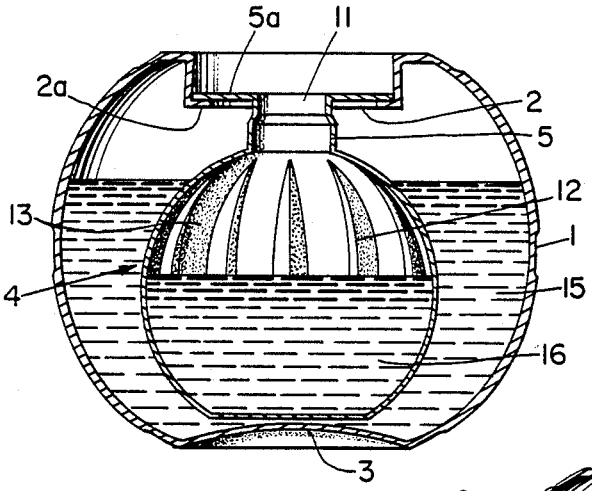
FIG. 11 is a vertical sectional view of the assembled container; showing the inner compartment to be partially filled with a liquid.

This leads to the situation shown in FIG. 11, where the sheath (13) has given rise to the inner compartment (4) in its final form. This same FIG. 11 shows the consecutive operation which consists in filling the inner compartment (4) with a liquid (16) which is introduced through the orifice (11). In the case of a liquid detergent for machine washing of laundry, this product (16) may be an additive of the peroxidic type.

Figure 12:
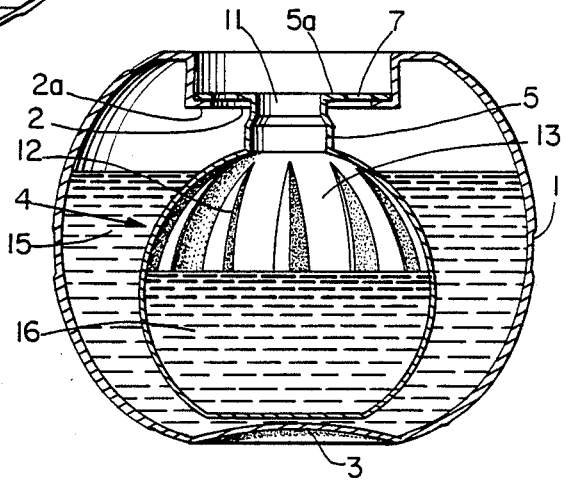
FIG. 12 is a vertical sectional view of the container of FIG. 11, showing holes in the annular region of the upper part of the inner compartment.

The operation illustrated in FIG. 12 is that of piercing the holes (7) in the flange (5*a*) situated in the upper part of the inner compartment (4). Six holes (7) for example, are pierced to produce an inner compartment such as illustrated in FIGS. 6 and 12, although a different number of holes may be employed.

Lastly, the upper part of the container is crowned with a hood of the type shown in FIG. 5.

Thus, the final product is a single-use container, with a double compartment, an inner compartment (4) in which there is an additive of the peroxidic type, and a second compartment, outside the compartment (4), which is held in the outer enclosure (1) and contains the liquid detergent formulation.

Before washing laundry in a machine, the hood is removed, so that the container is then available in the form illustrated in FIG. 12. The container as such is then placed in the drum of a machine for washing laundry. The liquid detergent (15) diffuses through the holes (7), while the contents (16) of the inner compartment (4) simultaneously pass through the orifice (11). The technical problem which is posed is thus solved by a washing process in which simultaneous use is made of two products which have been packaged separately in order to avoid any detrimental interaction if the products involved are not sufficiently compatible, as is the case with peroxidic additives and liquid washing aids.

The above description has been given merely by way of illustration. It is obvious that containers comprising compartments which are more that two in number may be employed for the process of the present invention. It then suffices to insert other compartments inside the inner compartment (4), using the same method as that illustrated in FIGS. 7 through 12.

Similarly, containers of overall spherical shape have been shown in the drawings since the latter is the most suitable for use in the drums of machines for washing laundry. Nevertheless, it would be completely possible for the containers to have a different, for example ovoid, shape, this shape being one of revolution, bearing in mind the use of a blowing process. In all cases, the walls bounding the various compartments of the container are impervious to the aqueous medium and to the liquid products usually employed in washing, cleaning or rinsing processes. In fact, the concept of the container for making use of the process according to the invention is based, on a directed distribution through the openings with which the compartments are respectively provided.

It will also be noted that the manufacture of the container, which is illustrated in FIGS. 7 through 12, may be modified. For example, the filling of the container may be performed once the inner compartment has been fabricated. Furthermore, the holes (7) may be made beforehand in the upper flange (5*a*) of the plastic sheath (13).

The invention also relates to a container for making use of the washing process, the container comprising a plurality of compartments, each of which is intended to receive a substance—or mixture of substances—which can be used in washing, but which do not exhibit a satisfactory compatibility with the substances in the other compartments, each of the latter having openings.

With a view to the use in a washing process according to the invention, the individual compartments of the container may be advantageously filled with selected constituents—or combinations of such constituents of detergent compositions. This eliminates the disadvantageous effects resulting from an inadequate compatibility of the ingredients and, furthermore, a set of effects which are advantageous for the cleaning and processing of textile fibres is obtained.

The process of the invention permits, separately and practically without any limitation, the packaging and the use of constituents or of combinations of constituents of detergent compositions. From a practical standpoint, it is frequently desirable to restrict the number of compartments in the container to two. In such case, these compartments may, for example, contain various combinations of constituents, such as granules/granules, granules/liquid and liquid/liquid.

In a preferred embodiment, the process of the invention provides for the use of a container in which one of the compartments contains a liquid detergent composition and the other a bleaching compound.

All types of liquid detergent compositions may be employed, including highly concentrated compositions containing no phosphate-based detergent adjuvant, as can liquid detergent compositions containing the customary quantities of surface-active agents and of customary phosphate and/or inorganic adjuvants.

The second compartment may be filled with a bleaching detergent agent. Examples of such bleaching agents are those containing oxygen or chlorine.

The process of the invention will be illustrated further, without being limited in any way, by the following description, which relates to a specific embodiment and demonstrates the advantages obtained in washing laundry. The outer compartment of a dispensing and distributing container of the type shown in FIG. 1 is filled with about 180 g of a liquid detergent for ordinary washing. The inner compartment is filled with about 32 g of perborate tetrahydrate and about 4 g of pellets of a peroxidic bleaching agent activator. The two-compartment container, containing the detergent formulation and the peroxygenated combination, is placed in the drum of an automatic washing machine with the textile articles to be washed. The washing cycle consists of a principal washing stage and one or more consecutive rinses.

In a very general manner, the second compartment may be employed for dispensing any detergent ingredient which, for all sorts of reasons, cannot be incorporated into the other detergent ingredients.

Nonlimiting examples of detergent ingredients which may be introduced into the second compartment are, in particular: bactericides, antioxidants, polycarboxylates such as polyacrylates, peroxidic bleaching agents such as diperoxydodecanedioic acid and magnesium monoperoxyphthalate, sodium hypochlorite, enzymes, storage-sensitive species, if appropriate, including oxydo-reductases, cellulases and lipases, appropriate textile softeners such as bentonites, smectites, hectorites, tallow diamines, fatty acids, detergency adjuvants such as sodium tripolyphosphate and sodium silicates, and soil-coagulating polymers.

What is claimed is:

1. Process for the machine washing of laundry in which there is introduced into the drum of a washing machine a container containing a predetermined quantity of a detergent composition and adapted to permit the gradual diffusion of the latter during the washing operation, said process being characterized in that the constituents of the detergent composition which do not have a satisfactory mutual compatibility are packaged separately in individual compartments of said container, each of the said compartments having openings such that, when the container is placed in the drum, the constituents of the detergent composition diffuse simultaneously and separately during the washing operation.

2. Process according to claim 1, characterized in that a two-compartment container is employed.

3. Process according to claim 2, characterized in that one of the compartments contains bleaching constituents intended to release active oxygen or chlorine during the washing operation, while the other compartment contains the remainder of the detergent composition.

4. Process according to any one of claims 1, 2, or 3, characterized in that a container is used into which, in each of the compartments which it comprises, there is introduced, at the time of use, the corresponding substance or the mixture of substances.

5. Process according to any one of claims 1, 2, or 3, characterized in that a container of the single-use type is used, containing beforehand, in each of the compartments, a predetermined quantity of substances—or of a mixture of substances—which are of help in the washing operation.

6. Process according to any one of claims 1, 2, or 3, characterized in that a container is employed in which the walls bounding the various compartments are impervious to the aqueous medium and to a liquid detergent employed for the washing operation.

* * * * *